US007828558B2

(12) United States Patent
Ma

(10) Patent No.: US 7,828,558 B2
(45) Date of Patent: Nov. 9, 2010

(54) ELECTRICAL CONNECTOR AND ELECTRICAL SYSTEM USING THE SAME

(75) Inventor: Hao-Yun Ma, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 86 days.

(21) Appl. No.: 12/228,018

(22) Filed: Aug. 8, 2008

(65) Prior Publication Data

US 2009/0042413 A1 Feb. 12, 2009

(30) Foreign Application Priority Data

Aug. 8, 2007 (CN) ..... 2007 2 0041466

(51) Int. Cl.
*H01R 12/00* (2006.01)

(52) U.S. Cl. ..... 439/66

(58) Field of Classification Search ..... 439/66, 439/81, 83, 78, 342, 345, 68, 331, 261
See application file for complete search history.

(56) References Cited

U.S. PATENT DOCUMENTS 5,057,031 A * 10/1991 Sinclair ..... 439/261
5,387,121 A * 2/1995 Kurz ..... 439/342
6,663,409 B1 12/2003 Liao et al.
6,749,441 B1 * 6/2004 Ma ..... 439/66
6,908,313 B2 6/2005 Walkup et al.
7,044,746 B2 5/2006 Copper et al.
7,322,830 B2 1/2008 Szu

* cited by examiner

*Primary Examiner*—Alexander Gilman
(74) *Attorney, Agent, or Firm*—Andrew C. Cheng; Wei Te Chung; Ming Chieh Chang

(57) ABSTRACT

The present invention provides an electrical connector system comprising an IC package and an electrical connector. The electrical connector comprises a base defining a plurality of passageways, a plurality of contacts received in the passageways, and a cover moveable relative to the base from a first position to a second position. The contacts each have a resilient arm extending out of the passageway and extending in a space defined by a lower surface of the cover and a mating surface of the base. The IC package is mounted on an upper surface of the cover, defining a plurality of pins through a plurality of through holes of the cover. During movement of the cover from the first position to the second position, the pins press on a surface of the resilient arm of the contact in a vertical direction and the resilient arms deflect toward an adjacent passageway.

3 Claims, 3 Drawing Sheets

ELECTRICAL CONNECTOR AND ELECTRICAL SYSTEM USING THE SAME

BACKGROUND OF THE INVENTION

1. Field of the Invention

The present invention relates to the art of electrical connectors. In detail, the present invention relates to a central processing unit (CPU) socket and an assembly using the same.

2. Background of the Invention

CPU sockets are widely used for establishing electrical connection between CPU and a printed circuit board (PCB)/motherboard. Therefore, CPU sockets are mounted on motherboards and hold CPUs execution of programs. Several types of CPU sockets are available with different structures. For example, type of Land Grid Array (LGA) sockets, which are found in U.S. Pat. No. 7,044,746 issued to Copper on May 16, 2006, and U.S. Pat. No. 6,908,313 issued to Walkup on Jun. 21, 2005. For example, type of Pin Grid Array (PGA) socket, which is found in U.S. Pat. No. 6,663,409 issued to Liao on Dec. 16, 2003.

Electrical connection between an electrical contact of a LGA socket and an IC package (e.g. CPU) is established by a pressing manner. The electrical contact of a LGA socket generally comprises a long resilient arm extending out of passageway of an insulative housing of the socket. The resilient arm has a contacting portion, and the IC package has a conductive pad corresponding to the contacting portion. Pad of the IC package is contacting with the contacting portion in a space out of the passageway of the insulative housing. The LGA socket has an advantage of easily using, easily to get a high-density layout of the contacts. But the LGA socket has a disadvantage of hardly to meet the trend of miniaturization of the socket.

A typical PGA socket is different from a LGA socket. In a PGA socket, an electrical contact is generally received in a passageway entirely, and the IC package has pin to be inserted into the passageway. The insulative housing of the PGA socket has an advantage of miniaturization; but PGA socket is hardly to provide a high-density layout of the contacts because of the contact received in the housing requiring a large cavity.

In view of foregoing, a new electrical connector system is needed to overcome the above-mentioned shortcomings.

SUMMARY OF THE INVENTION

Accordingly, an object of the present invention is to provide an electrical connector that maximizes the quantity of contacts and reduces the size of the housing.

To achieve the above-mentioned object, in a preferred embodiment of the present invention, the present invention provides an electrical connector system comprising an IC package (e.g. CPU) and an electrical connector. The electrical connector comprises a base defining a plurality of passageways, a plurality of contacts each received in a passageway, and a cover mounted on the base and moveable relative to the base from a first position to a second position. The cover defines a plurality of through holes corresponding to the plurality of contacts of the base; and the plurality of contacts each have a resilient arm extending out of the passageway and extending in a space defined by a lower surface of the cover and a mating surface of the base. The IC package is mounted on an upper surface of the cover, defining a plurality of pins through the through holes of the cover. During the movement of the cover from the first position to the second position, the pins of the IC package press on a surface of the resilient arm of the contact in a vertical direction, and the resilient arms deflect toward an adjacent passageway. Thus electrical engagement between the pins and the resilient arms occurs in the vertical direction in the space defined by the lower surface of the cover and the mating surface of the base.

Other objects, advantages and novel features of the present invention will become more apparent from the following detailed description when taken in conjunction with the accompanying drawings.

BRIEF DESCRIPTION OF THE DRAFLANGES

DETAILED DESCRIPTION OF THE PREFERRED EMBODIMENT OF THE INVENTION

Reference will now be made to accompany drawings to describe the present invention in detail.

Figure 1:
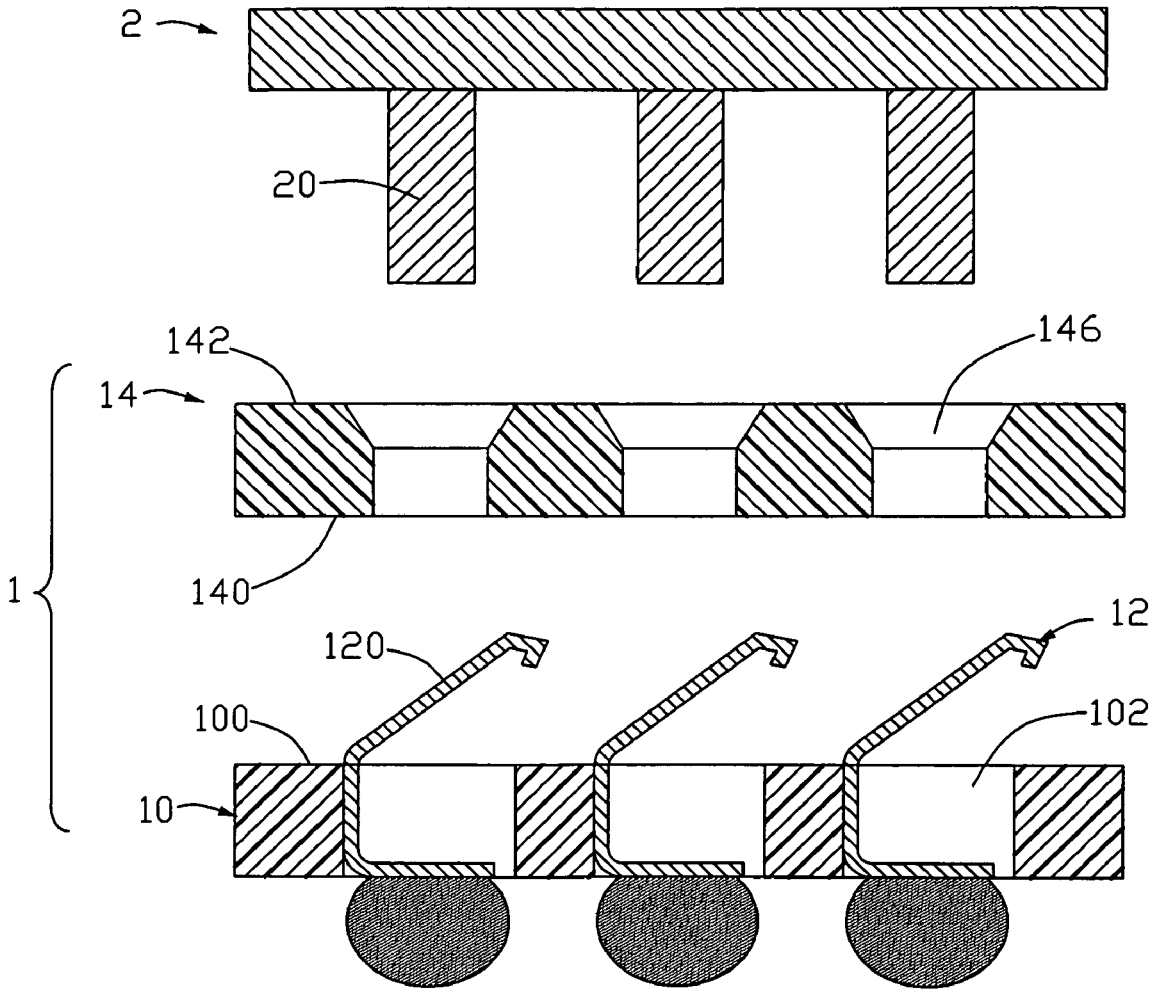
FIG. 1 is an exploded, sketch view of an electrical connector system in accordance with a preferred embodiment of the present invention, wherein the IC package is ready to be mounted on the electrical connector.
Figure 2:
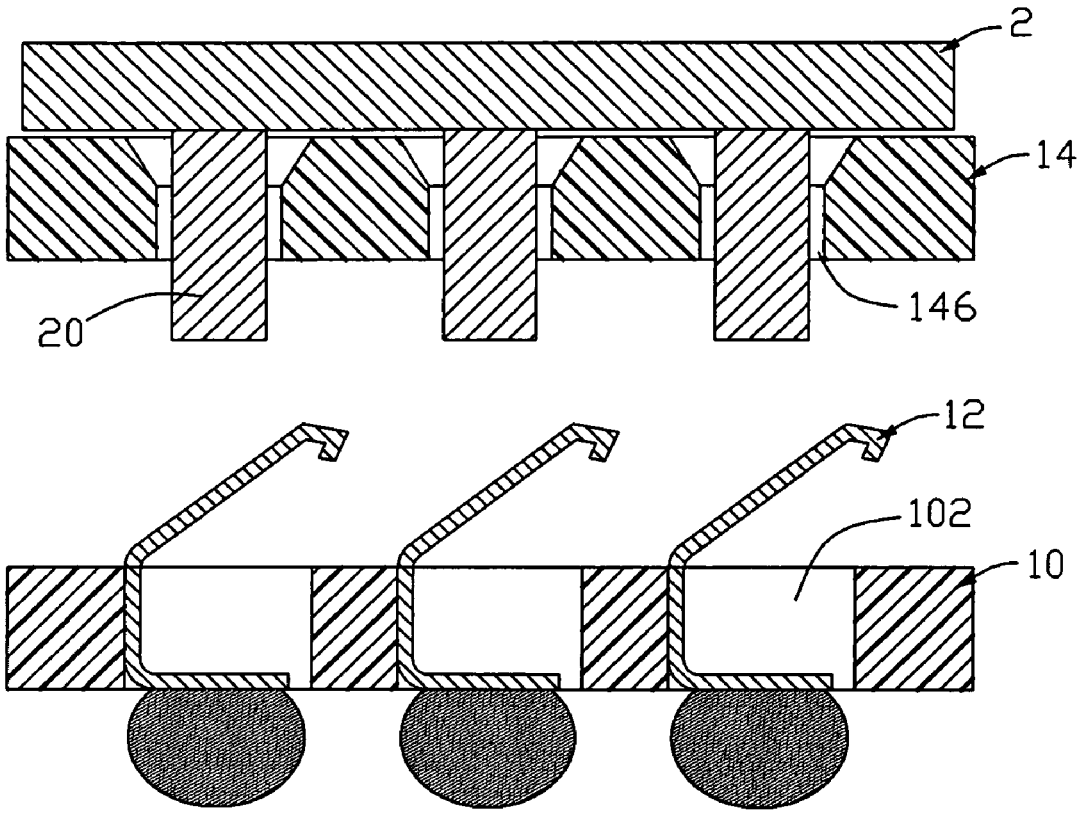
FIG. 2 is a sketch view of the electrical connector system; the IC package being mounted upon the cover without pushed toward the base.
Figure 3:
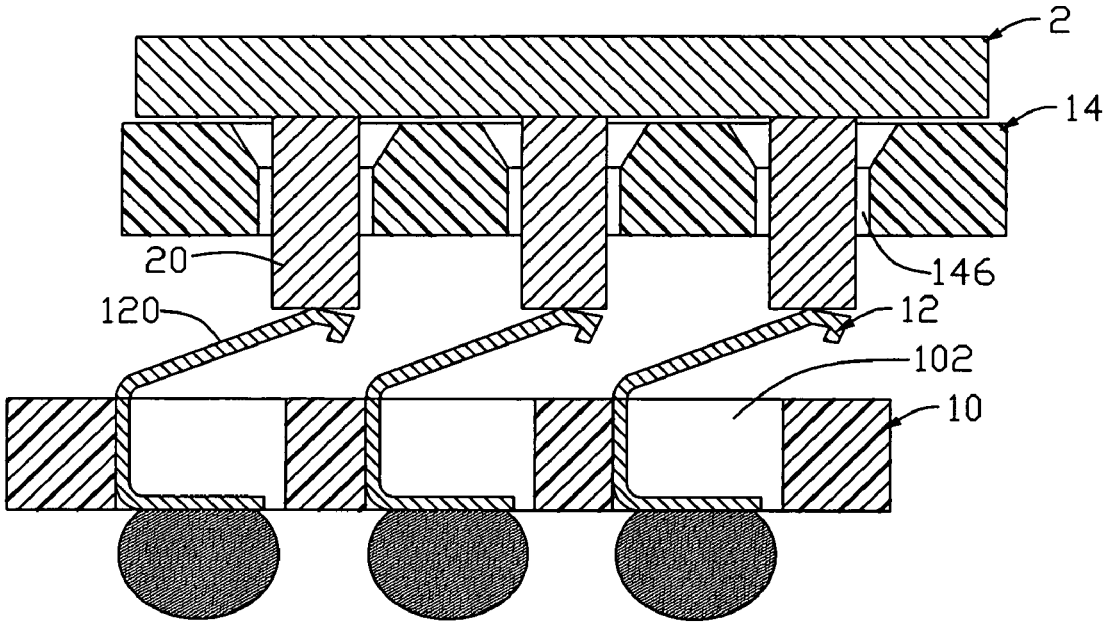
FIG. 3 is a sketch view of the electrical connector system, and the IC package is pushed toward the base and contacting with the contact after a sliding movement elative to the cover.

Referring to FIGS. 1-3, according to a preferred embodiment of the present invention, the electrical connector system comprises an electrical connector 1 and an IC package 2 (e.g. CPU). The electrical connector 1 is used for establishing electrical connection between the IC package 2 and a PCB (not shown).

The electrical connector 1 comprises base 10, a plurality of contacts 12 received in the base 10, and a cover 14. The base 10 has a mating surface 100 with a plurality of passageways 102. Each of he plurality of contacts 12 is received in a passageway 102, and has a resilient arm 120 extending out of the passageway 102. The resilient arm 120 extends toward an adjacent passageway 102 and defines a lower end for electrically connecting with the PCB via soldering art.

The cover 14 is moveably mounted upon the base 10, defining a bottom surface 140 corresponding to the mating surface 100 of the base 10 and an upper surface 142 opposite to the bottom surface 140. A plurality of through holes 146 extends through both the upper surface 142 and the bottom surface 140. Each of the plurality of through holes 146 is configured to ensure a pin 20 of the IC package 2 to be inserted into. The plurality of through holes 146 each define a guiding slot (not labeled), which is formed by a chamfer arranged at a position near the upper surface 142.

After the cover 14 is assembled to the base 10, the resilient arms 120 of the contacts 12 are extending in a space defined by the mating surface 100 of the base 10 and the bottom surface 140 of the cover 14.

It is needed to point out; an actuator (not shown) will be arranged between the base 10 and the cover 14. As a conventional PGA socket, the actuator may be an eccentric cam or an operating lever. The actuator is used for driving the cover 14 to slide relative to the base 10 from a first position to a second position, which is well know to a people having ordinary skill in the art.

The IC package 2 is mounted upon the upper surface 142 of the cover and has a plurality of pins 20 corresponding to the through holes 146.

Referring to the FIGS. 2-3, a process of establishes electrical connection between the IC package 2 between the electrical connector 1 is shown. FIG. 2 shows the cover 14 is at the first position, pins 20 of IC package 2 be inserted into the through holes 146 of the cover 14 and the passageways 102 of the base 10. At this time, the pins 20 do not contact with any contacts 12. Referring to FIG. 3, while the cover 14 is at the second position, the pins 20 are contacting with the contacts 12. During above movement, the resilient arms 120 of the contacts 12 are compressed in said vertical direction and resiliently deform to generate elastic force to assure mechanical and electrical engagement with the pins 20. In detail, the pins 20 are pressing on a surface of the resilient arms 120 in a vertical direction, and mechanical and electrical engagement between the pins 20 and the resilient arms 120 occurs in the vertical direction and in a space defined by the mating surface 100 of the base 10 and the bottom surface 140 of the cover 14. The resilient arms 120 of the contacts 12 will deflect toward an adjacent passageway 102.

According to the preferred embodiment of the present invention, the pins 20 of the IC package contact with the resilient arm 120 of the contact 12. The pins need not to be inserted into the passageway 102. Thus, the contacts 12 do not need a large cavity arranged in the passageway 102. The engagement part of the contacts 12 is a plurality of resilient arm 120, thus a high-density layout of the contacts 12 is provided.

Although the present invention has been described with reference to the accompanying drawings, it is not to be construed as being limited thereto. Various alterations and modifications can be made to the embodiments without in any way departing from the scope or spirit of the present invention as defined in the appended claims. Such modifications and alterations that may be apparent to a person skilled in the art are intended to be included within the scope of this invention as defined in by the accompanying claims.

What is claimed is:

1. An electrical connector assembly comprising:

an insulative base equipped with a plurality of contacts therewith, each of said contacts including a contacting section upwardly extending above an upper face of the base;

an insulative cover spaced from the base in a vertical direction and moveable relative to the base in a horizontal direction, and defining a plurality of through holes adjacent to the contacting sections of the corresponding contacts thereunder, respectively; and an electronic package located upon the cover and including a plurality of pole-like conductors downwardly extending into and through the corresponding through holes, respectively, with tip sections below a bottom face of the cover with a distance; wherein the tip sections mechanically and electrically engage the contacting sections of the corresponding contacts, respectively;

wherein the cover is moved together with the electronic package downwardly in the vertical direction once the electronic package is seated thereupon with the conductors extending through the corresponding through holes of the cover.

2. An electrical connector assembly comprising:

an insulative base equipped with a plurality of contacts therewith, each of said contacts including a contacting section upwardly extending above an upper face of the base;

an insulative cover spaced from the base in a vertical direction and moveable relative to the base in a horizontal direction, and defining a plurality of through holes adjacent to the contacting sections of the corresponding contacts thereunder, respectively; and an electronic package located upon the cover and including a plurality of pole-like conductors downwardly extending into and through the corresponding through holes, respectively, with tip sections below a bottom face of the cover with a distance; wherein the tip sections mechanically and electrically engage the contacting sections of the corresponding contacts, respectively;

wherein said cover is moveable relative to the base in the vertical direction.

3. An electrical connector assembly comprising:

an insulative base equipped with a plurality of contacts therewith, each of said contacts including a contacting section upwardly extending above an upper face of the base;

an insulative cover spaced from the base in a vertical direction and moveable relative to the base in a horizontal direction, and defining a plurality of through holes adjacent to the contacting sections of the corresponding contacts thereunder, respectively; and an electronic package located upon the cover and including a plurality of pole-like conductors downwardly extending into and through the corresponding through holes, respectively, with tip sections below a bottom face of the cover with a distance; wherein the tip sections mechanically and electrically engage the contacting sections of the corresponding contacts, respectively;

wherein when the tip section of said conductor and contacting section of the corresponding contact are engaged with each other, said tip section pushes said contacting section to be downwardly deflected.

* * * * *